US005979310A

United States Patent [19]

Nagarsheth et al.

[11] Patent Number: 5,979,310

[45] Date of Patent: Nov. 9, 1999

[54] APPARATUS AND METHOD FOR PRINTING IMAGES

[75] Inventors: Pushpavadan S. Nagarsheth, Danbury; Donald T. Dolan, Ridgefield, both of Conn.

[73] Assignee: Pitney Bowes Inc., Stamford, Conn.

[21] Appl. No.: 08/751,290

[22] Filed: Nov. 18, 1996

[51] Int. Cl.[6] ..... B41L 47/46

[52] U.S. Cl. ..... 101/91; 101/92; 347/41

[58] Field of Search ..... 101/91, 92, 93, 101/93.01, 93.04, 93.05; 347/2, 4, 41; 395/108, 109, 110; 364/464.02

[56] References Cited

U.S. PATENT DOCUMENTS

| | | | |
|---|---|---|---|
| 2,660,111 | 11/1953 | Herrick et al. . | |
| 3,376,812 | 4/1968 | Sterling . | |
| 3,522,769 | 8/1970 | Priesmeyer | 101/3 |
| 3,536,007 | 10/1970 | Harvey | 101/327 |
| 3,688,695 | 9/1972 | James | 101/211 |
| 3,701,317 | 10/1972 | Miyameric | 101/170 |
| 3,724,369 | 4/1973 | Gery | 101/327 |
| 3,732,809 | 5/1973 | Sawada | 101/35 |
| 3,752,068 | 8/1973 | Trampoech | 101/93 |
| 3,869,986 | 3/1975 | Hubbard | 101/91 |
| 3,964,383 | 6/1976 | Delligatti | 101/44 |
| 4,052,938 | 10/1977 | Kirby | 101/291 |
| 4,116,126 | 9/1978 | Miner | 101/77 |
| 4,402,263 | 9/1983 | Honkawa | 101/350 |
| 4,403,547 | 9/1983 | Forberger | 101/170 |
| 4,508,034 | 4/1985 | Schuneman | 101/365 |
| 4,611,538 | 9/1986 | Simeth | 101/365 |
| 4,615,266 | 10/1986 | DeRoche et al. | 101/163 |
| 5,355,155 | 10/1994 | Mistyurik | 101/91 |
| 5,440,979 | 8/1995 | Bonham et al. | 101/91 |
| 5,471,935 | 12/1995 | Heinrich et al. | 101/91 |
| 5,765,475 | 6/1998 | Salomon | 101/91 |
| 5,806,421 | 9/1998 | Dolan et al. | 101/93.01 |

*Primary Examiner*—Christopher A. Bennett
*Attorney, Agent, or Firm*—Ronald Reichman; Robert Whisker; Melvin J. Scolnick

[57] ABSTRACT

An apparatus and method for printing images. An ink jet printhead forms an image on a transfer roller for transfer to a substrate. The substrate can be an envelope and the image can be a postal indicia. Portions of the image can be interleaved during successive revolutions of the transfer roller to increase the horizontal and/or vertical resolution of the image. A mechanism is provided to deflect the substrate away from the transfer roller after the image is printed so that formation of a new image can begin before the substrate has cleared the print station.

21 Claims, 5 Drawing Sheets

FIG. 6

| NIP | | PRINTHEAD |
|---|---|---|
| | T0 | START 1ST REVOLUTION |
| | T1 | START PRINT 1ST PORTION |
| | * | |
| | * | |
| | * | |
| | T2 | END PRINT 1ST PORTION |
| | T3 | START 2D REVOLUTION |
| | T4 | START PRINT 2D PORTION |
| | * | |
| | * | |
| BEGIN PRINT IMAGE (begin cleaning) | T5 | |
| | T6 | END PRINT 2D PORTION |
| | T7 | START 3RD REVOLUTION |
| | T8 | START PRINT 1ST PORTION |
| END PRINT IMAGE (start defflect envelope) | T9 | |
| | * | |
| ENVELOPE DEFLECTED (end cleaning) | T10 | |
| | T11 | END PRINT 1ST PORTION |
| | T12 | START 4TH REVOLUTION |
| | T13 | START PRINT 2D PORTION |
| | * | |
| | * | |
| BEGIN PRINT IMAGE (begin cleaning) | T14 | |
| | T15 | END PRINT 2D PORTION |
| | T16 | START 5TH REVOLUTION |
| | T17 | START PRINT 1ST PORTION |
| END PRINT IMAGE (start defflect envelope) | T18 | |
| | * | |
| ENVELOPE DEFLECTED (end cleaning) | T19 | |
| | T20 | END PRINT 1ST PORTION |
| | T21 | START 5TH REVOLUTION |
| | * | |
| | * | |

APPARATUS AND METHOD FOR PRINTING IMAGES

BACKGROUND OF THE INVENTION

The subject invention relates to an apparatus and method for printing images. More particularly, it relates to an apparatus and method for printing images such as postal indicia printed by postage meters to evidences that appropriate postage has been paid on a mail piece. The recorded amount is decremented until either sufficient funds do not remain to pay additional postage or the meter is reset to record payment of an additional amount to a postage service.

As evidence that postage has been paid, i.e. that the prepaid amount stored in the meter has been properly decremented, a postage meter will print a postal indicia on a mail piece. A typical indicia is shown in FIG. 1. Indicia 10 includes fixed elements such as city name 92, state 94, meter identification 18, an arbitrary and complex elements 20, and variable elements such as date 22 and, of course, postage amount 24 represented by the indicia. Typically, indicia 10 have been printed by complex mechanical rotary or flat bed printing elements which include a fixed printing element for printing fixed information and adjustable elements for printing adjustable information. It is apparent that postage indicia 10 has an intrinsic value equal to amount 24 in that it is equivalent to a stamp having that value. For this reason city and state identifications 92 and 94 meter identification 18 and date 22 are provided to facilitate detection of fraudulent use of meters and arbitrary and complex design 20 is included to make counterfeiting of indicia more difficult.

Such meters have been highly successful and are presently used to account for the expenditure of billions of dollars of postage in the United States alone. However, as postage rates have increased so has the value of postal indicia and this, together with the need of postal services for increased revenue, has created a demand for a postage meter which is more secure against fraud and counterfeiting. To achieve this it has been proposed that the amount of variable information in the indicia be increased, particularly that the indicia include encrypted information which would vary from indicia to indicia so that counterfeit indicia could not be produced without knowledge of the encryption method and key used.

Additionally it is very advantageous to provide users of postage meters with the ability to print ads or slogans along with the postal indicia, and it would be highly desirable to enable these users to easily vary such ads or slogans.

For these and other reasons it has long been recognized that it would be highly desirable to provide a postage meter which used digital, or matrix, printing techniques so that the desired indicia including any ads or encrypted information, could be printed under direct control of a postage meter CPU.

One particularly desirable form of digital printing which has been proposed for use in a postage meter is ink jet printing, and particularly piezoelectric ink jet printing. One such postage meter is described in commonly assigned, co-pending U.S. patent application Ser. No. 554,179, filed: Nov. 6, 1995, for: MAIL HANDLING APPARATUS AND PROCESS FOR PRINTING AN INDICIA COLUMN - BY - COLUMN IN REAL TIME, by: Arsenault et al. (E -394) In this meter a printhead having a number of ink jets is oriented transversely to the printing direction and is moved over the mail piece to print the indicia. Because the printhead has a density of 80 jets per inch while a vertical resolution of 240 dots per inch is desired for the indicia the ink jet described in the above referenced application prints the indicia in 3 interleaved passes. (Other approaches to increased the vertical resolution of ink jet printing include angling the head from the vertical and the use of staggered multiple heads. However these approaches obviously increase both the cost and complexity of the printing mechanism.)

While the postage meter described in the above referenced application does successfully overcome many of the problems of prior art postage meters, some problems remain.

Since the printhead is moved over the mail piece in 3 separate passes clearly the mail piece must be stopped during printing while it would be desirable for the mail piece to move continuously through the meter. Also, even if multiple or angled printheads were used to provide adequate vertical resolution problems remain combining adequate resolution in the printing, or horizontal, direction together with a high through put rate.

Also, since the product of the horizontal resolution and the through put speed, (i.e. the relative speed of the mail piece with respect to the printhead) is equal to the printhead frequency (i.e. the frequency with which a jet can emit discrete ink droplets). Since there is an inherit maximum printhead frequency for each printhead improvements in the horizontal resolution can only be obtained by trading off throughput.

Another problem with ink jet printing apparatus in a postage meter is that the movement of paper mail pieces through a meter generates substantial amounts of paper dust which is believed to have a very adverse effect on ink jet printheads.

Thus it is object of the subject invention to provide an improved apparatus and method for printing images such as postal indicia.

BRIEF SUMMARY OF THE INVENTION

The above object is achieved and the disadvantages of the prior art are overcome in accordance with the subject invention by means of an apparatus and method wherein an image forming mechanism is controlled by signals representative of images to be printed to form a reverse of a first portion of a variable image on a transfer roller during a first revolution of the roller, and controlled to form a reverse of a second portion of the variable image on the transfer roller during a second revolution of the roller, where the second portion is interleaved with the first portion. The completed image, including the interleaved first and second portions is then transferred to a substrate.

In accordance with one aspect of the subject invention additional portions of the variable image may be interleaved during additional revolutions of the transfer roller.

In accordance with another aspect of the subject invention the special relationship between the imaging forming mechanism and the substrate is adjusted to interleave the first and second portions vertically.

In accordance with another aspect of the subject invention, the timing relationship between formation of the first and second portions is adjusted to interleave the first and second portions horizontally. (i.e. in the printing direction).

In accordance with still another aspect of the subject invention the transfer of the completed image is begun before the image is completely formed on the transfer roller.

In accordance with yet another aspect of the subject invention the transfer roller is formed from a resilient material selected to conform to surface irregularities in the substrate.

In accordance with still yet another aspect of the subject invention the substrate is a mail piece and the variable indicia is a postal indicia representative of a postal charge for the mail piece.

Those skilled in the art will recognize that the subject invention achieves the above object and overcomes the disadvantages of the prior art and will recognize other objects and advantages of the subject invention from the detailed description set forth below.

BRIEF DESCRIPTION OF THE DRAWINGS

FIG. 6 shows a timing diagram of operation of one embodiment of the subject invention.

DETAILED DESCRIPTION OF PREFERRED EMBODIMENTS OF THE INVENTION

Figure 2:
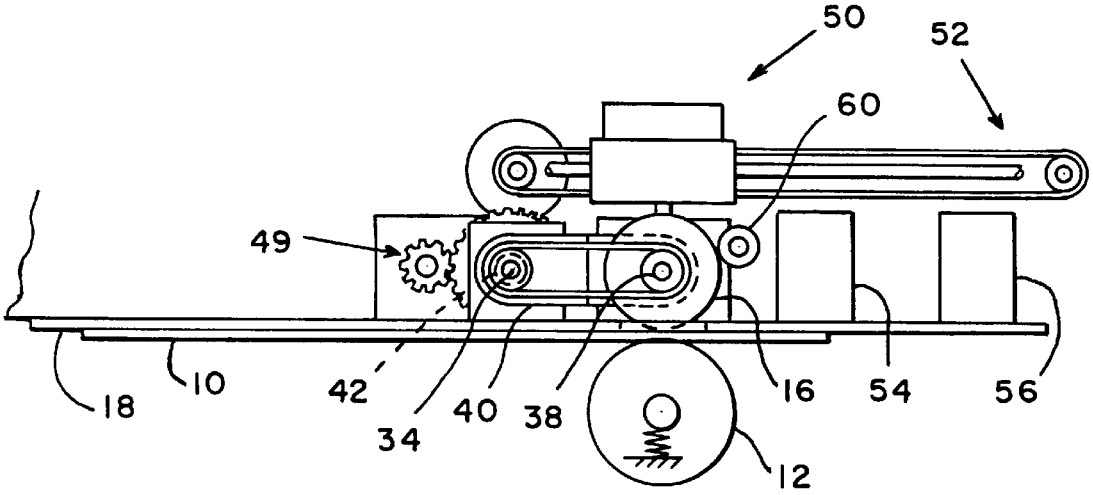
FIG. 2 shows a schematic side view of a printing apparatus in accordance with the subject invention.
Figure 3:
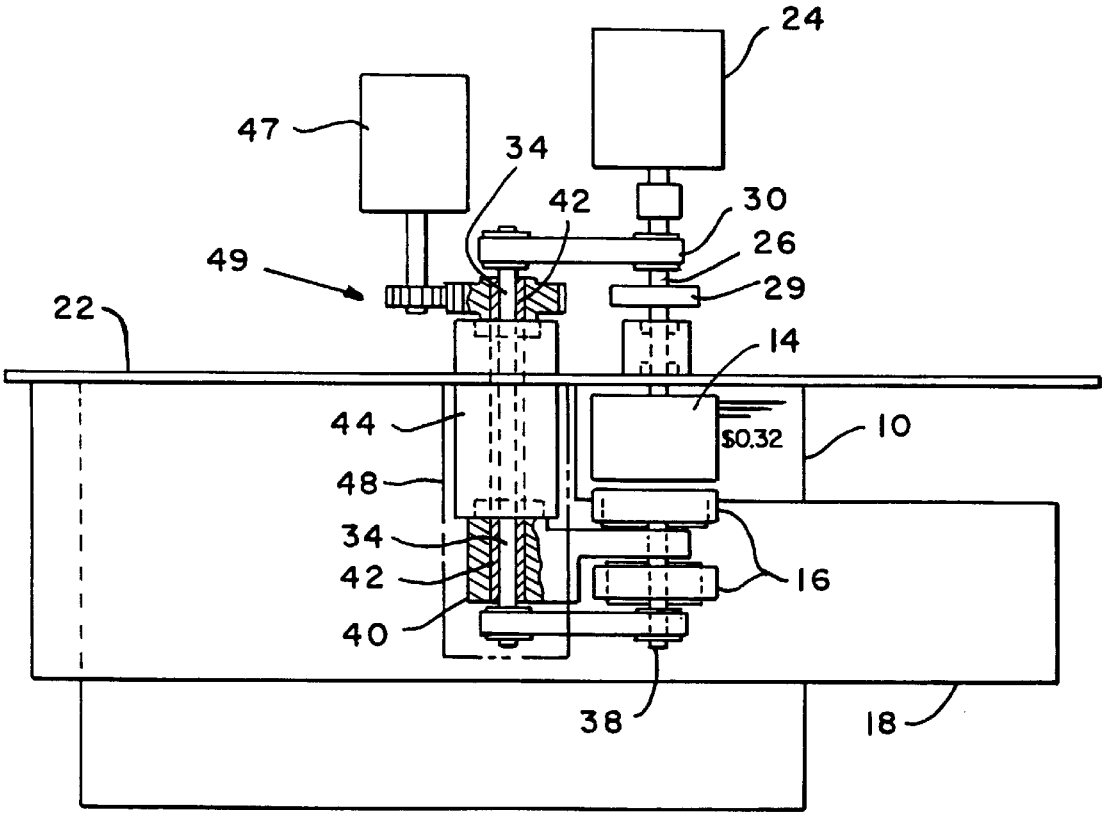
FIG. 3 shows a schematic top view of the apparatus of FIG. 2 with the image forming mechanism removed.

FIGS. 2 and 3 show a schematic representation of a printing apparatus in accordance with the subject invention. Various details of the construction not explicitly shown form no part of the subject invention per se and numerous implementations of these details would be apparent to those skilled in the art.

Envelope 10 is fed to the printing apparatus of FIGS. 2 and 3 by a conventional demand feeder (not shown) which is controlled in a conventional manner to provide envelope 10 to the printing apparatus in synchronism with the operation of the printing apparatus.

Envelope 10 is fed into the nip formed by spring loaded impression roller 12, and transfer roller 14 and driven pivot rollers 16.

Envelope 10 is maintained in a predetermined registration with respect to transfer roller 14 by upper registration surface 18 and vertical registration surface 22.

Transfer roller 14 is driven by print motor 24 through shaft 26 which is supported by bearing block 28. A conventional encoder 29 provides angular position information in a conventional manner to synchronize control of the printing operation, as will be describe further below. Pivot rollers 16 are also coupled to motor 24 by shaft 26, belt 30, inner coaxial shaft 34, belt 36, and shaft 38. Rollers 16 are thus arranged to rotate synchronously with, but separate from, transfer roller 14. Shaft 38 and roller 16 are supported by pivot arm 40 which is fixed to outer coaxial shaft 42, supported by pivot bearing block 44.

Shoe 48 is fixed to pivot arm 40 and is normally co-planar with registration surface 18.

Pivot motor 47 drives outer shaft 42 through reduction gear assembly 49 to rotate pivot arm 40, rollers 16 and shoe 48 downwards out of the plane of registration surface 18 to deflect envelope 10 away from transfer roller 14 as envelope 10 moves through the printing apparatus as will be described further below.

The manner in which envelope 10 is transported or deflected after printing is not critical to the subject invention and numerous other mechanisms are within the contemplation of the subject invention. For example, envelope 10 can be transported by a belt and a spring biased shoe can be driven by a cam to deflect envelope 10.

Turning to FIG. 2 a conventional ink jet printhead 50 is supported in a predetermined registration with transfer roller 14 so that the nozzles of printhead 50 are arranged in a line parallel to the axis of transfer roller 14 preferably at a location 180 degrees from the nip of transfer roller 14 and impression roller 12. Transport mechanism 52 supports printhead 50 and, under system control, transports printhead 50 to maintenance station 54 and capping station 56 between printing operations. (Maintenance and capping of ink jet printheads are conventional operations, well known in the art, and need not be discussed further here for an understanding of the subject invention.) Transport mechanism 52 also transports printhead 50 in the vertical direction (i.e. the direction parallel to the axis of transfer roller 14 and transverse to the print direction) to interleave successive portions of a completed image in successive passes. (i.e. revolutions of transfer roller 14)

In a preferred embodiment of the subject invention an articulated cleaning roller or pad is provided. Roller or pad 60 is operated under system control to bear against transfer roller 14 and remove any excess remaining ink after an image has been printed on envelope 10.

Figure 1:
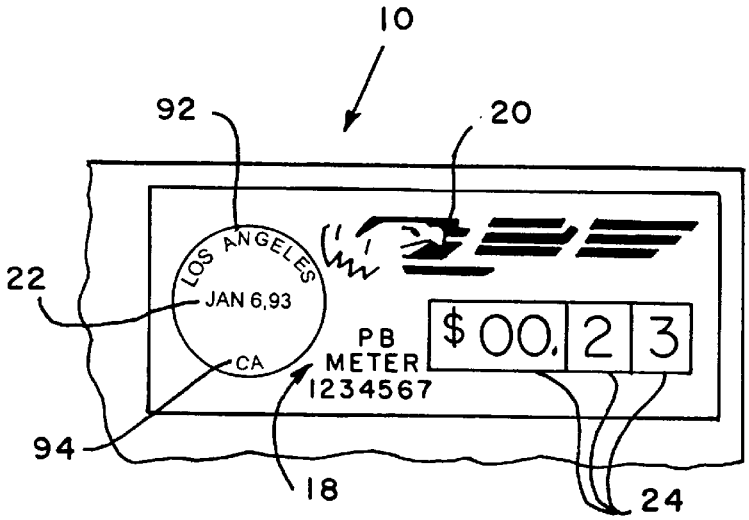
FIG. 1 (PRIOR ART)
FIG. 1 shows a typical postal indicia.
Figure 4:
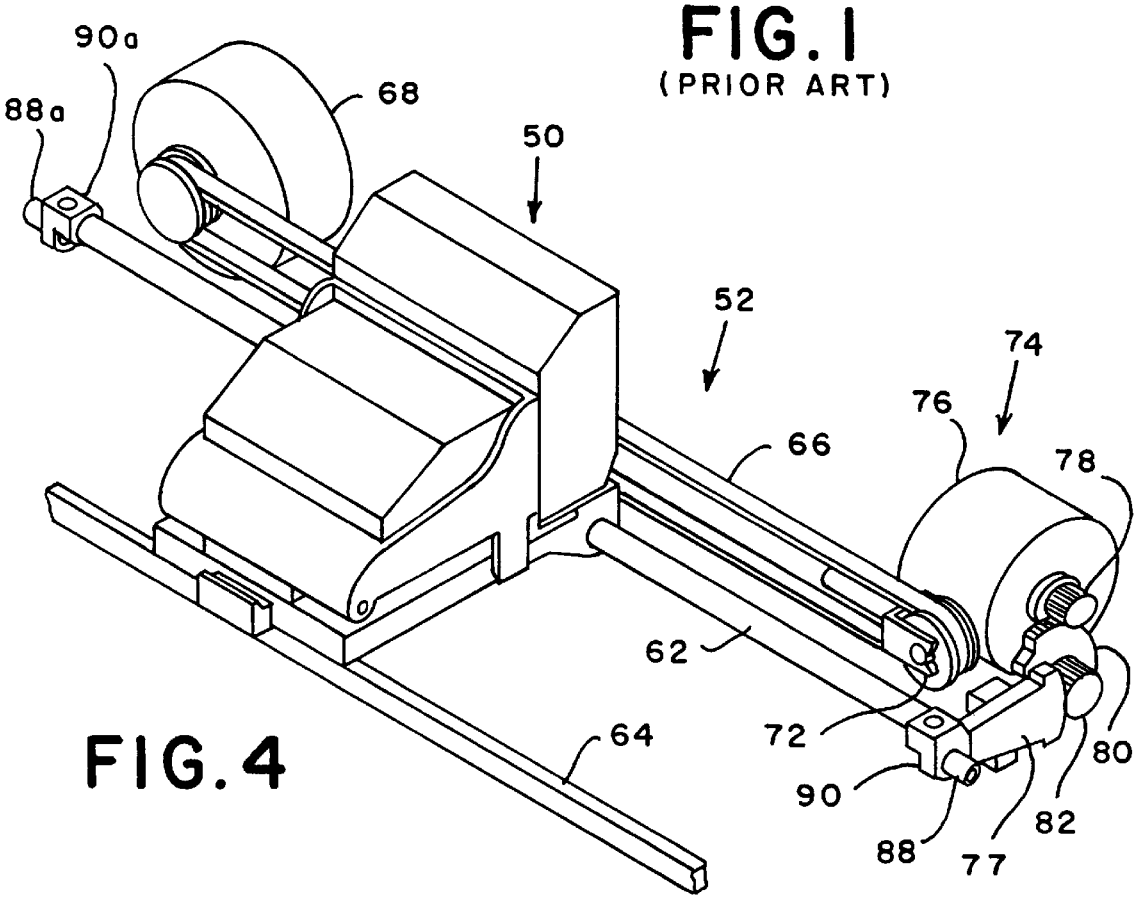
FIG. 4 shows a perspective view of a transport mechanism used in one embodiment of the subject invention.

FIG. 4 shows a more detailed representation of transport mechanism 52. Printhead 50 is mounted on guide bar 62 and is free to rotate around the axis of guide bar 62. The front of printhead 50 rests upon, and is free to slide along, rail 64. Printhead 50 is attached to endless belt 66 which is supported by motor 68 and pulley 72 so that motor 68 can transport printhead 50 between its normal position above transfer roller 14 and maintenance station 54 and capping station 56.

Shifting mechanism 74 moves printhead 50 in the vertical direction. Mechanism 74 includes a stepper motor 76 which drives lever arm 77 through gear trained 78, 80, 82 to rotate around shaft 88. L-shaped element 90 is fixed to lever arm 77 and rotates around shaft 88 when lever arm 77 is driven. One end of guide 62 is supported by L-shaped element 90 eccentrically with respect to shaft 88. The opposite, undriven end of guide 62 is supported by similar shaft 88A and L-shaped element 90A. Thus, as stepper motor 76 drives lever arm 77 printhead 50 is moved through a small part of an arc in the vertical direction. However, since printhead 50 is free to rotate around guide 62 and slide across support 64 any displacement out of the plane is negligible. Preferably, mechanism 74 is designed so that one step of stepper motor 76 moves printhead 50 a small fraction of a pixel size in the vertical direction.

Thus printhead 50 may be operated in either of two modes to print portions of a complete reversed image onto transfer roller 14 during successive passes. In the first mode the circumference of transfer roller 14 may be chosen so that an adequate dead space is provided between the beginning and end of the reversed image on roller 14 so that printhead 50 may be displaced by a full pixel dimension between completion of the printing of one portion and beginning of printing of the next portion. In the second mode of operation printhead 50 is successively displaced by sub-pixel increments as each portion of the reversed image is printed so that printhead 50 is displaced by a full pixel dimension after the entire portion is printed. This, of course, will slightly tilt the printed image but it is believed that for images such as postal indicia this effect will be negligible and that compensation for this effect can be made in designing the indicia.

A more complete description of transport mechanism 52 is provided in commonly assigned, co-pending U.S. patent application Ser. No. 579,505, filed: Dec. 27, 1995, for: APPARATUS FOR PRINTING AN IMAGE INDICATIVE OF VALUE SUCH AS A POSTAL INDICIA, by: Kawahara et al. (E -475), which is hereby incorporated by reference.

Figure 5A:
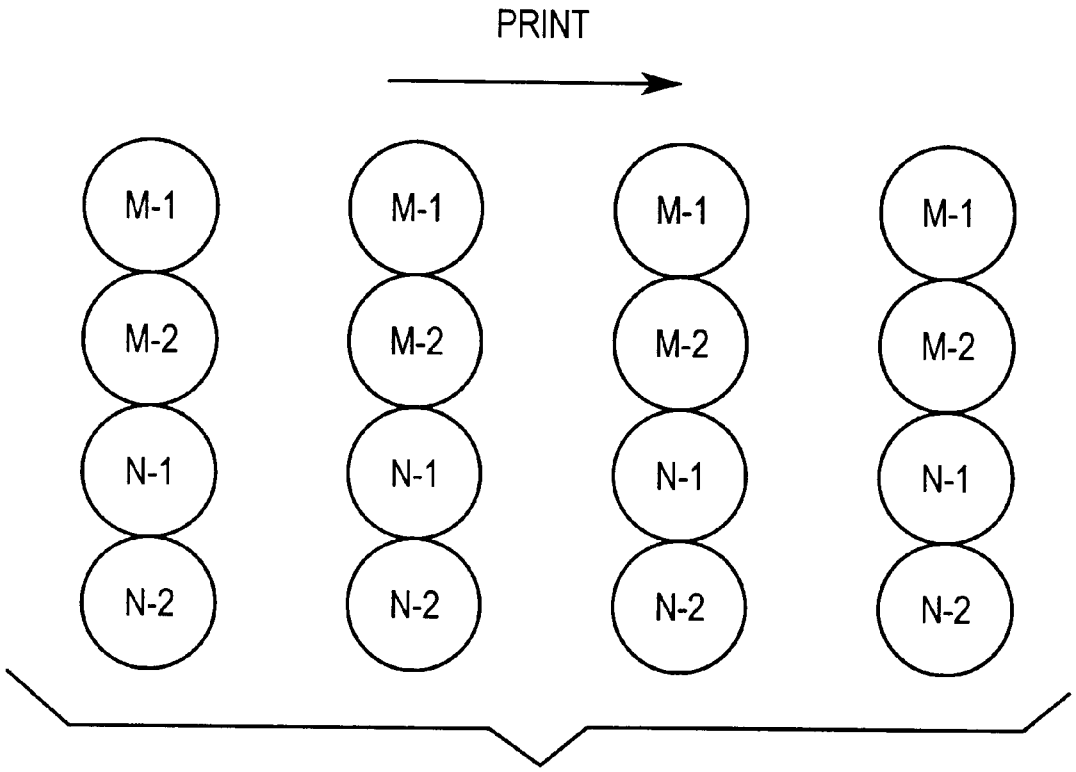
FIGS. 5A, B, and C show various patterns in which portions of a image may be interleaved in accordance with the subject invention.
Figure 5B:
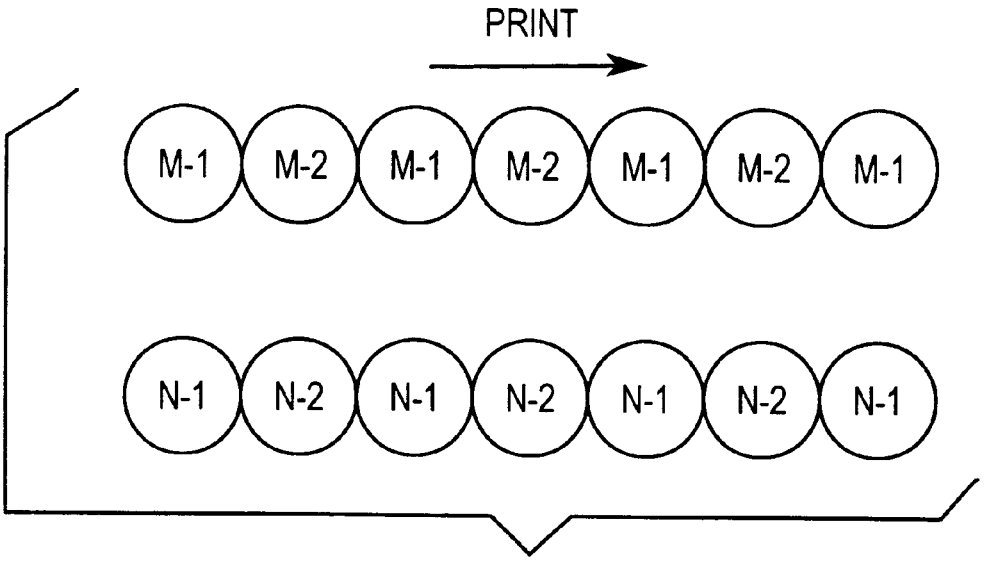
Figure 5C:
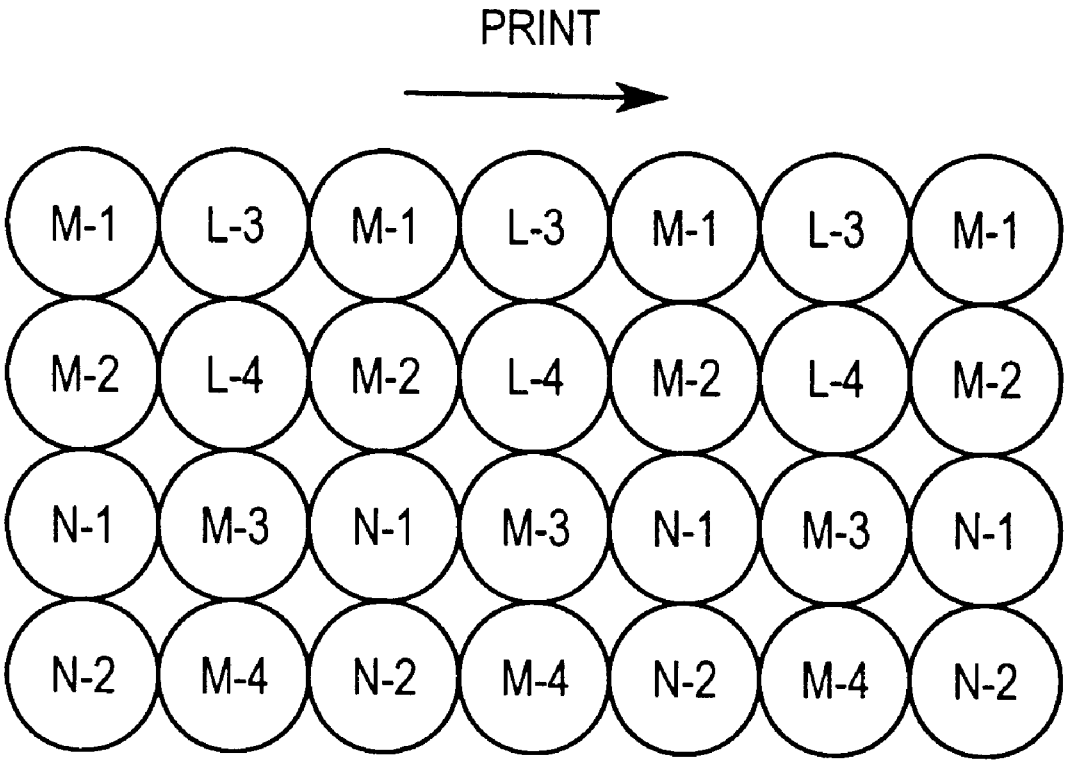

FIGS. 5A, 5B and 5C, show various ways in which the above described printing apparatus can be used to increase the resolution of an image produced by an ink jet printhead with little or no sacrifice of through put.

In these figures the printing patterns produced by two or three adjacent nozzles in printhead 50 are illustrated. Pixels mark x-i represent pixels produced by the xth nozzle during the ith pass or revolution of roller 14.

One problem in producing images with piezoelectric ink jet printers is that because of the physical requirements of piezoelectric ink jet printheads the linear density of nozzles in a printhead is limited to approximately 80 per inch. However, acceptable images such as postal indicia may require densities in the vertical direction of 240 dots per inch, or more. FIG. 5A illustrates the operation of the printing apparatus of the subject invention to increase vertical resolution. During a first pass nozzles M and N print odd rows of an image, and during a second pass print even rows of an image thus doubling the vertical resolution of the image.

Another problem with the printing of images using ink jet printers, particularly of the bubble jet type, is that ink jet printers can only produce droplets at a limited rate, typically approximately 4,000 droplets per second. For this reason increasing the resolution of the printed image in the horizontal (i.e. printing) direction requires slowing down the rate at which the substrate passes the printhead, thus reducing through put. FIG. 5B shows the operation of the printing apparatus of the subject invention in increasing the horizontal resolution of a printed image. During a first pass nozzles M and N print the odd columns of an image and during a second pass print the even columns. Note that no vertical displacement of the printhead is necessary in this mode of operation.

Finally, FIG. 5C shows the operation of the printing apparatus of the subject invention to increase both the horizontal and vertical resolution of the printed image. During the first pass nozzles M and N print the odd columns of the odd rows. During the second pass nozzles M and N print the even columns of the even rows. During the third pass nozzles L and M print the even columns of the odd rows and during the fourth pass nozzles L and M print the odd columns of the odd rows. Those skilled in the art will recognize that in this mode of operation the first nozzle of the printhead will be inoperative during the first two passes and the last nozzle of the printhead will be inoperative during the last two passes.

While the modes of operation illustrated in FIGS. 5A, 5B and 5C have shown no more then a 2-times increase in resolution, those skilled in the art will recognize that by the incorporation of additional passes and/or additional printheads, essentially unlimited increases in vertical and/or horizontal resolution can be obtained. Care, however, should be taken when multiple printheads are used to assure that the printheads are aligned in parallel and are equally spaced from the transfer roller to assure acceptable image quality.

While it is known to overcome the resolution problem described above by transporting a printhead for repeated passes above a stationary substrate, is as for example in the above referenced commonly assigned U.S. patent application, this approach has several difficulties. Because of the need to return the printhead to an initial position between each pass it is slow. (Printing on the return path is generally not considered to be an acceptable option since the variation in pixels formed by droplets generated with the head and substrate moving in opposites directions creates distortions in the image for which it is difficult and/or expensive to compensate.

Further, the need to halt the substrate during the printing operation decreases throughput and increases the complexity of the operation.

FIG. 6 shows how the printing apparatus of the subject invention may be used to overcome these disadvantages. FIG. 6 shows a time line of events occurring at the printhead and at the nip of transfer roller 14 and impression roller 12, which in the preferred embodiment shown are separated by 180 degrees.

At time T0 the first revolution of roller 14 (i.e. the first pass) begins. At time T1 printhead 50 beings printing the first portion of the reversed image onto transfer roller 14. At time T2 the first portion of the reverse image is completed and at time T3 the second revolution begins.

Delays between the beginning of a revolution and the beginning of printing a portion of an image and between the completion of printing and the beginning of the next revolution are provided to allow some tolerance in when the envelope must arrive at the nip, provide time to deflect the envelope from transfer roller 14 after the image is printed, and to provide additional time to clear the envelope from the printing apparatus and bring the next envelope to the nip, and, if necessary, to provide time to move printhead 50 to print the next row of pixels.

Then, at time T4 printhead 50 begins printing the second portion of the image. One half revolution later, at T5 printing of the image to envelope 10 begins at the nip of transfer roller 14 and impression roller 12. (Assuming that the completed image consist of only two portions.) Then, at T6, printing of the second portion to transfer roller 14 ends. At T7 the third revolution begins and at T8 printing of the first portion of the next image to transfer roller 14 begins. Then, at T9 printing to envelope 10 is completed. At this point envelope 10 is deflected away from transfer roller 14 by shoe 48. Deflection of envelope 10 must be completed by time T10, One half revolution after T8 when printing of the next image began.

Also, during the period from time T5 until time T10 cleaning roller or pad 60 may be brought into contact with transfer roller 14 to remove residual ink.

At time T11 printing of the first portion of the next image is complete, and at time T12 the fourth revolution begins, and at time T13 printing of the second portion of the next image begins. One half revolution later, at time T14 printing of the next image begins at the nip of transfer roller 14 and impression roller 12. This of course implies that impression roller 12 and 40 have returned to their normal positions and that the leading edge of the next envelope is at the nip. At T15 printing of the reversed second image is complete and at T16 the fifth revolution begins. At T17 printing of the first portion of another reversed image to transfer roller 14 begins, while at T18 printing to the next envelope ends.

Those skilled in the art will recognize that once deflection of envelope 10 has completed at time T10 operation of the printing apparatus of the subject invention in accordance with FIG. 5 allows one revolution of roller 14 before printing of the next envelope must begin. Unless envelope 10 is small in comparison to the length of the image printed this may not, in general, be sufficient. One approach to solving this problem would be to provide a mechanism for accelerating envelope 10 after it is printed so that it would quickly clear the printing apparatus making way for the next envelope.

An alternative approach would be to take advantage of the fact that transfer roller 14 is featureless. Thus the initial point on the roller at which a printing cycle begins can be chosen arbitrarily. This can be achieved by adding an appropriate delay after time T6 when the complete reversed image has been printed on transfer roller 14, before the beginning of the next print cycle at time T7, the beginning of the third revolution. This delay will appear at the nip of transfer roller 14 and impression roller 12 one half revolution later, delaying the time by which deflection must be completed and the time at which printing of the next envelope must begin by the delay amount.

Appropriate delay amounts can be determined either by detecting the trailing edge of envelope 10, or from an a priori knowledge of the length of envelope 10.

EXAMPLE

It is believed that satisfactory performance can be achieved by using an ink having the following properties in a piezoelectric ink jet printhead to form images on a silicon rubber transfer roller:

| | |
|---|---|
| viscosity | 4–7 centipoise |
| surface tension | 40–60 millinewtons/meter |
| pH | 4–7 |

Formulation of a suitable ink would be well within the ability of an ink chemist of ordinary skill. The durometer of the transfer roller is not believed to be critical and can be selected to conform to anticipated surface irregularities.

The above description of preferred embodiments of the subject invention has been provided by way of illustration only and numerous other embodiments of the subject invention will be apparent to those skilled in the art from consideration of the detailed descriptions set forth above and the attached drawings. Accordingly, limitations on the subject invention are to be found only in the claims set forth below.

What Is claimed:

1. A method for printing an image on a substrate, said substrate having a length in the printing direction greater than the length of said variable image, said method comprising the steps of:

a) controlling an image forming mechanism responsive to signals representative of images to be printed to form a reverse of said image on a transfer roller;

b) transferring said image to said substrate as said substrate is transported into a contracting relationship with said transfer roller;

c) after transferring said image, displacing said substrate from said transfer roller and beginning formation of a next variable image as said substrate is transported clear of said transfer roller.

2. A method as described in claim 1 wherein said controlling step comprises the substeps of:

a) controlling said image forming mechanism to form a reverse of a first portion of said image on said transfer roller during a first revolution of said roller; and b) controlling said image forming mechanism to form a reverse of a second portion of said image during a second revolution of said roller, said second portion being interleaved with said first portion.

3. A method as described in claim 2 wherein said portions are interleaved so as to increase both the horizontal and vertical resolution of said completed image.

4. A method as described in claim 1 comprising the further step of adjusting the spatial relationship of said image forming mechanism to interleave said first and second portions vertically.

5. A method as described in claim 4 wherein said spatial relationship is adjusted incrementally after formation of said first portion.

6. A method as described in claim 4 wherein said spatial relationship is adjusted substantially continuously during formation of said completed image.

7. A method as described in claim 1 wherein transfer of said completed image is begun before said image is completely formed on said transfer roller.

8. A method as described in claim 1 wherein transfer roller is formed from a resilient material selected to conform to surface as regularities in said substrate.

9. A method as described in claim 1 wherein said substrate is a mail piece.

10. A method as described in claim 9 wherein said variable indicia is a postal indicia representative of a postal charge amount for said mail piece.

11. A method as described in claim 1 comprising the further step of adjusting the timing relationship between formation of said first and second portions to interleave said first and second portions horizontally.

12. A method for printing a variable image on a substrate, comprising the steps of:

a) controlling an image forming mechanism responsive to signals representative of images to be printed to form a reverse of a first portion of said variable image on a transfer roller during a first revolution of said roller;

b) controlling said image forming mechanism to form a reverse of a second portion of said variable image on said transfer roller during a second revolution of said transfer roller, said second portion being interleaved horizontally with said first portion; and c) transferring a completed image comprising said interleaved first and second portions to a substrate.

13. A method as described in claim 12 further comprising the step of controlling said image forming mechanism to form a reverse of an additional interleaved portion of said variable image on said transfer roller during an additional revolution of said transfer roller.

14. Printing apparatus, comprising:

a) transfer roller;

b) image forming means responsive to a signal representative of said variable image for forming a reverse of said image on said transfer roller; and c) transport means for bringing said substrate into contact with said roller means as said transfer means rotates, whereby said image is transferred to said substrate; and d) diverter means for diverting said substrate out of contact with said transfer roller after said image is transferred; whereby formation of a next image can begin substantially immediately.

15. A printing apparatus as described in claim 14 wherein said image forming apparatus is further for:

a) forming a reverse of a first portion of said variable image on said roller means; then b) forming a reverse of a second, interleaved portion of said variable image of said roller means.

16. A printing apparatus as described in claim 14, further comprising means for adjusting the spatial relationship of said image forming means and said roller means to interleave said first and second portions.

17. A printing apparatus as described in claim 15 wherein said adjusting means adjusts said spatial relationship incrementally after formation of said first portion.

18. A printing apparatus as described in claim 15 wherein said adjusting means adjusts said spatial relationship substantially continuously during formation of said image.

19. A printing apparatus as described in claim 13 wherein said transport means brings said substrate into contact with said roller means and transfer of said image begins before said image is fully formed on said roller means.

20. A printing apparatus as describe in claim 13 wherein said roller means comprises a resilient roller selected to conform to surface irregularities in said substrate.

21. A printing apparatus as described in claim 14 wherein said image forming means is further for adjusting timing between forming of said first and second portions to interleave said first and second portions.

* * * * *